US010895270B2

(12) United States Patent
Todsen et al.

(10) Patent No.: US 10,895,270 B2
(45) Date of Patent: Jan. 19, 2021

(54) HYDRAULIC ACTUATOR WITH PRESSURE AMPLIFIER

(71) Applicant: PistonPower APS, Sønderborg (DK)

(72) Inventors: Jørgen P. Todsen, Nordborg (DK); Tom Tychsen, Nordborg (DK); Peter Zavadinka, Nordborg (DK); Lubos Vokel, Nordborg (DK); Juraj Hanusovsky, Nordborg (DK); Jørgen Mads Clausen, Nordborg (DK)

(73) Assignee: PISTONPOWER APS, Sønderborg (DK)

( * ) Notice: Subject to any disclaimer, the term of this patent is extended or adjusted under 35 U.S.C. 154(b) by 0 days.

(21) Appl. No.: 16/347,013

(22) PCT Filed: Oct. 12, 2017

(86) PCT No.: PCT/EP2017/076110

§ 371 (c)(1),
(2) Date: May 2, 2019

(87) PCT Pub. No.: WO2018/082893

PCT Pub. Date: May 11, 2018

(65) Prior Publication Data

US 2019/0271332 A1 Sep. 5, 2019

(30) Foreign Application Priority Data

Nov. 4, 2016 (EP) ..... 16197299

(51) Int. Cl.
*F15B 3/00* (2006.01)
*F15B 15/14* (2006.01)
*F15B 15/20* (2006.01)

(52) U.S. Cl.
CPC ..... *F15B 3/00* (2013.01); *F15B 15/1457* (2013.01); *F15B 15/204* (2013.01); *F15B 2211/214* (2013.01)

(58) Field of Classification Search
CPC ..... F15B 3/00; F15B 15/1457; F15B 15/204; F15B 2211/214
See application file for complete search history.

(56) References Cited

U.S. PATENT DOCUMENTS 4,030,299 A * 6/1977 Reuschel ..... B29C 45/67 60/560
5,170,691 A * 12/1992 Baatrup ..... F04B 9/107 417/403

(Continued)

FOREIGN PATENT DOCUMENTS

CN 2601156 Y 1/2004
CN 105221494 A 1/2016

(Continued)

OTHER PUBLICATIONS

International Search Report for Serial No. PCT/EP2017/076110 dated Dec. 15, 2017.

(Continued)

*Primary Examiner* — Thomas E Lazo
(74) *Attorney, Agent, or Firm* — McCormick, Paulding & Huber PLLC

(57) ABSTRACT

A hydraulic actuator (1) is disclosed comprising a cylinder housing (2), a piston (5) with a piston rod (6) being displaceably arranged inside the cylinder housing (2) and a pressure amplifier (10) comprising an inlet section (18) with a pressure inlet port (20), an active section (19) with a high pressure outlet port (22), a low pressure chamber (32) and a high pressure chamber (38*a*). It is an objective of the invention to provide a hydraulic actuator (1) with a modular pressure amplifier (10). To this end, the inlet section (18) is arranged inside the piston rod (6), and wherein the low pressure chamber (32) is stationarily arranged relative to the inlet section (18).

20 Claims, 5 Drawing Sheets

(56) References Cited

U.S. PATENT DOCUMENTS

| | | | | |
|---|---|---|---|---|
| 6,295,914 | B1 * | 10/2001 | Iversen | F15B 3/00 91/300 |
| 7,354,252 | B2 * | 4/2008 | Baatrup | F04B 9/107 417/245 |
| 7,597,545 | B2 * | 10/2009 | Pedersen | F15B 3/00 417/225 |
| 2004/0115070 | A1 | 6/2004 | Baatrup et al. | |
| 2012/0304633 | A1 * | 12/2012 | Rozzi De Hieronymis | F15B 15/204 60/393 |
| 2019/0120258 | A1 | 4/2019 | Zavadinka | |
| 2019/0271332 | A1 | 9/2019 | Todsen et al. | |

FOREIGN PATENT DOCUMENTS

| | | | |
|---|---|---|---|
| CN | 105465063 | A | 4/2016 |
| DE | 2452221 | A1 | 5/1976 |
| DE | 102004061298 | A1 | 6/2006 |
| DE | 102006011637 | A1 | 9/2007 |
| DE | 102007054774 | B3 | 9/2008 |
| RU | 2059895 | C1 | 10/1996 |
| RU | 2450173 | C1 | 5/2012 |
| WO | 2011104662 | A1 | 9/2011 |

OTHER PUBLICATIONS

International Search Report for Serial No. PCT/EP2017/076112 dated Dec. 15, 2017.

* cited by examiner

HYDRAULIC ACTUATOR WITH PRESSURE AMPLIFIER

CROSS-REFERENCE TO RELATED APPLICATIONS

This application is a National Stage application of International Patent Application No. PCT/EP2017/076110, filed on Oct. 12, 2017, which claims priority to European Patent Application No. 16197299.7, filed on Nov. 4, 2016, each of which is hereby incorporated by reference in its entirety.

TECHNICAL FIELD

The invention relates to a hydraulic actuator comprising a cylinder housing, a piston with a piston rod being displaceably arranged inside the cylinder housing and a pressure amplifier comprising an inlet section with a pressure inlet port, an active section with a high pressure outlet port, a low pressure chamber and a high pressure chamber.

BACKGROUND

Such hydraulic actuators are known and used in different industrial sectors. They are, for example, used to drive mechanical members for pressing, cutting or the like. In such applications said mechanical members encounter a resistance induced by the work piece to be pressed or cut. This resistance may well vary during the working process. Therefore, it is important that the hydraulic actuator can provide sufficient working pressure during all stages of the working process. As the pressure needed does depend on the resistance induced by the working piece, also the pressure demand to be provided by the hydraulic actuator varies.

In order to avoid a shortfall of pressure during the working process, it is known to make use of pressure amplifiers in connection with the hydraulic actuator. Said pressure amplifiers comprise an inlet section with an inlet port. Hydraulic fluid used to operate the hydraulic actuator enters the inlet section through the inlet port. The hydraulic fluid passes through the low pressure chamber. The pressure of the hydraulic fluid is subsequently enhanced. It then passes through the high pressure chamber and exits the pressure amplifier via the high pressure outlet port of the active section. Thereby, an amplification of the pressure of the hydraulic fluid inside the hydraulic actuator can be achieved. An increased pressure demand of the hydraulic actuator can be met.

However, it also apparent that additional elements, such as the pressure amplifier with its pressure inlet port, inlet section, active section and high pressure outlet port need to be added to the hydraulic actuator. A fluid communication between the hydraulic actuator and the pressure amplifier has to be established. Typically, in order to achieve this, the technical design of the hydraulic actuator needs structural modifications or additional parts. Such a modified technical design makes construction and assembly cumbersome and expensive. The hydraulic actuator and the pressure amplifier need to be assembled concomitantly. The different parts of the hydraulic actuator and the pressure amplifier need to be machined for each other.

SUMMARY

It is therefore an objective of the present invention to provide a hydraulic actuator with a modular pressure amplifier.

This objective is achieved in that the inlet section is arranged inside the piston rod, and wherein the low pressure chamber is stationarily arranged relative to the inlet section.

Arrangement of the inlet section inside the piston rod makes a modular construction of the pressure amplifier possible. No additional construction space is needed to arrange the inlet section in. The pre-existing parts of the hydraulic actuator may be used for this purpose. A fluid connection between the hydraulic actuator and the inlet section may be easily established. In arranging the low pressure chamber stationarily relative to the inlet section, the number of moving parts within the hydraulic actuator and the pressure amplifier can be kept small. Wear due to friction between the different parts is avoided. The lifetime of the hydraulic actuator and the pressure amplifier can be enhanced. During a stroke of the piston, the volume of the low pressure chamber remains constant. As the low pressure chamber is stationarily arranged relative to the inlet section, and the inlet section is arranged inside the piston rod, the low pressure chamber follows the movement of the piston rod during a stroke of the piston. However, the volume of the low pressure chamber remains constant during such strokes.

In another embodiment, the active section is arranged inside the piston rod, and wherein the high pressure chamber is stationarily arranged relative to the active section. Arrangement of the active section inside the piston rod makes a modular construction of the pressure amplifier possible. No additional construction space is needed to arrange the active section in. The pre-existing parts of the hydraulic actuator may be used for this purpose. A fluid communication between the hydraulic actuator and the active section may be easily established. In arranging the high pressure chamber stationarily relative to the active section, the number of moving parts within the hydraulic actuator and the pressure amplifier can be kept small. Wear due to friction between the different parts is avoided. The lifetime of the hydraulic actuator and the pressure amplifier can be enhanced. During a stroke of the piston, the volume of the high pressure chamber remains constant. As the high pressure chamber is stationarily arranged relative to the active section, and the active section is arranged inside the piston rod, the high pressure chamber follows the movement of the piston rod during a stroke of the piston. However, the volume of the high pressure chamber remains constant during such strokes.

In another embodiment, the high pressure chamber is arranged inside the active section, and wherein the piston rod comprises a piston head fixing the active section inside the piston rod. The amount of constructional space needed can further be reduced significantly by arranging the high pressure chamber inside the active section. The pressure amplifier comprises two sections: the inlet section and the active section, because of the assembly of all internal parts thereof. In order to achieve a proper function of the pressure amplifier, the inlet section and the active section need to be fixed in their respective position. To this end, an external force must be applied. This fixing of the position of the active section can easily be achieved by making use of the constructional features of the hydraulic actuator. As the active section is arranged inside the piston rod, the piston head can conveniently be used to fix the position of the active section within the piston rod. The piston head force-fittingly fixes the position of the active section. It exerts an external force onto the active section.

In yet another embodiment, the low pressure chamber is arranged inside the inlet section, and wherein the piston rod fixes the inlet section inside the piston rod. The amount of constructional space needed can further be reduced significantly by arranging the low pressure chamber inside the inlet section. The pressure amplifier comprises two sections: an inlet section and the active section, because of the assembly of all internal parts thereof. In order to achieve a proper function of the pressure amplifier, the inlet section and the active section need to be fixed in their respective position. To this end, an external force must be applied. This fixing of the position of the inlet section can easily be achieved by making use of the constructional features of the hydraulic actuator. As the inlet section is arranged within the piston rod, the piston rod can conveniently be used to fix the position of the inlet section within the piston rod. The piston rod force-fittingly fixes the position of the inlet section. It exerts an external force onto the inlet section. Put another way, the position of the active section is stationarily arranged relative to the inlet section. Both the inlet section and the active section are arranged within the piston rod. At the same time, the volumes of the low pressure chamber and the high pressure chamber are constant. The position of the low pressure chamber relative to the position of the high pressure chamber is also stationary. The piston head and the piston rod fix the position of the inlet section and the active section relative to one another. The pressure amplifier can be assembled as a module inside the piston rod. The piston itself functions as a sleeve holding the inlet section and the active section together with external force. A proper function of the pressure amplifier is thus ensured.

In another embodiment, the piston rod comprises a piston rod side port arranged in a radial direction of the piston rod establishing a fluid communication between the pressure amplifier and the cylinder housing. The piston rod side port is used as a backflow inlet port and/or a backflow outlet port of the pressure amplifier. The piston rod side port is accompanied by a piston side port. The piston side port may be arranged concentrically with the piston rod inside the piston head. The piston side port functions as the high pressure outlet port of the pressure amplifier. It establishes a fluid communication between the pressure amplifier and the working chamber of the cylinder housing.

In yet another embodiment, the pressure inlet port and the high pressure outlet port are coaxially arranged at opposite axial ends of the pressure amplifier. This arrangement facilitates the supply of the pressure amplifier with hydraulic fluid. It is, for example, possible to arrange the pressure inlet port in the vicinity of a piston eye. The channels supplying the pressure amplifier with hydraulic fluid via the pressure inlet port may then be arranged inside the piston rod and the piston eye. The pressure inlet port and the high pressure outlet port are coaxially arranged in order to avoid imbalances. It also achieves an effective transmission of hydraulic fluid from the pressure amplifier to the hydraulic actuator.

In another embodiment, the inlet section comprises a pilot sequence valve being in fluid communication with the pressure inlet port and being arranged in an axial direction of the inlet section. The pilot sequence valve may be thread mounted in the axial direction into the inlet section. The bottom of the pilot sequence valve is therein connected to the pressure inlet port through a main inlet channel. The pilot sequence valve is normally closed. In this way, it allows for full flow of hydraulic fluid inside the main inlet channel. The axial arrangement of the pilot sequence valve allows for an easy and compact assembly.

In yet another embodiment, the pilot sequence valve is pressure-activated when the pressure at the pressure inlet port exceeds a preset value, thereby opening a pilot channel from the pressure inlet port to the low pressure chamber. The bottom of the pilot sequence valve is connected to the pressure inlet port through the main inlet channel. It is connected through the first pilot channel to a first control valve pin. The first control valve pin forms part of the fluid connection from the pilot sequence valve via the pilot channel to the low pressure chamber. The pilot sequence valve is normally closed. In this state, it blocks the fluid communication associated with the first control valve pin to the low pressure chamber. Once the pressure of the hydraulic fluid in the inlet section reaches a preset value, the pilot sequence valve opens. Thereby, the pilot channel from the pressure inlet port to the low pressure chamber opens. The pressure of the hydraulic fluid is subsequently amplified in view of the increased pressure demand. The setting of the pilot sequence valve to a preset value can be adjustable. The setting of the pilot sequence valve may also be fixed to a certain preset value.

In another embodiment, the active section comprises an over-center valve establishing a fluid communication between the pressure inlet port and the high pressure outlet port and being arranged in an axial direction of the active section. The over-center valve comprises multiple parts which are integrated inside the active section in an axial direction thereof. Once the inlet section and the active section are mounted with respect to each other, it is no longer possible to set a pressure level of the over-center valve. Therefore, proper setting is achieved by several types of springs. Those springs form part of the multiple parts of the over-center valve. The over-center valve can provide a full flow from the pressure inlet port to the high pressure outlet port. Moreover, it may provide a load holding function at the high pressure outlet port thus meeting an increased pressure demand in the hydraulic actuator. Eventually, the over-center valve may also provide a controlled lowering function from the high pressure outlet port to the pressure inlet port, thus avoiding too steep pressure drops. The over-center valve comprises three connection ports: an over-center valve inlet port associated with the main inlet channel, an over-center valve outlet port associated with a second high pressure channel as well as an over-center valve pilot port associated with a pilot line. The pilot line connects the over-center valve with the main backflow channel. In a direction from the pressure inlet port to the high pressure outlet port, the over-center valve provides a full flow of the hydraulic fluid through the main inlet channel. This can be achieved by means of a check valve integrated in the over-center valve. In the opposite flow direction, from high pressure outlet port to pressure inlet port, the over-center valve blocks flow of hydraulic fluid. However, once the pressure applied to the pilot line exceeds a certain preset value, the over-center valve opens a fluid path from the high pressure outlet port to the main backflow channel.

In yet another embodiment, the over-center valve is mounted on a first axial end face of the inlet section, wherein the first axial end face of the inlet section abuts a first axial end face of the active section. The over-center valve comprises multiple parts such as several types of springs. These parts are mounted in the axial direction of the active section in a space-saving manner. Therein, a dividing plane is constituted by the abutment of the first axial end face of the inlet section and the first axial end face of the active section. All parts of the over-center valve are mounted on the first axial end face of the inlet section, i.e. from the dividing plane. Correct positioning of all parts of the over-center valve can therefore be achieved by covering the first axial end face of the active section with the first axial end face of the inlet section. There is no need for thread-mounting of the over-center valve. No thread in the active section is needed. Assembly and manufacturing of the pressure amplifier becomes easy and inexpensive.

In another embodiment, the low pressure chamber comprises a low pressure piston and a low pressure piston bushing, wherein the low pressure piston is displaceably arranged relative to the low pressure piston bushing. The low pressure piston bushing is an easy and cost-efficient way of increasing the lifetime of the low pressure piston. This is achieved by decreasing the friction between the low pressure piston and the circumferential walls of the low pressure chamber of the inlet section. The low pressure piston bushing may, for example, be molded into the inlet section or may be mounted with a press fitting (depending on the material used for the bushing). It may consist of one piece. It may also consist of different pieces. The different pieces are then molded into the inlet section one after the other. Gaps between the different pieces are to be avoided. The correct position of the different pieces may be controlled by a jig during the molding process. After the molding process, the low pressure piston bushing needs to be machined to a certain inside diameter.

In another embodiment, the high pressure chamber comprises a high pressure piston and a high pressure piston bushing, wherein the high pressure piston is displaceably arranged relative to the high pressure piston bushing. The high pressure piston bushing is an easy and cost-efficient way of increasing the lifetime of the high pressure piston. This is achieved by decreasing the friction between the high pressure piston and the circumferential walls of the high pressure chamber of the active section. The high pressure piston bushing comprises two parts with different length: a first high pressure piston bushing element and a second high pressure piston bushing element. The correct position of the different bushings may be controlled by a jig during the molding process. After the molding process, the high pressure piston bushing needs to be machined to a certain inside diameter. The bushing may also be mounted with a press fitting.

In yet another embodiment, the high pressure piston bushing comprises an aperture opening a second pilot channel establishing a fluid communication between the high pressure chamber and a contral valve. The high pressure piston bushing may comprise the first high pressure bushing element and the second high pressure piston bushing element. Between these bushings, the aperture is located. The aperture opens the second pilot channel, once the high pressure piston has reached an axial end position at the far end of the inlet section inside the high pressure chamber. The lifetime of the pressure amplifier can be increased by means of the bushing, while at the same time ensuring its proper function. The high pressure piston bushing can be implemented without the need for modifying the constructional features of the pressure amplifier.

In another embodiment, the pressure amplifier comprises an internal adapter establishing a fluid communication between the pressure inlet port and a piston inlet port. The piston inlet port may be arranged inside the piston eye. The piston inlet port may be a drilled hole inside the piston eye. The piston inlet port may be concentrically arranged with the piston rod. The internal adapter connects the piston inlet port with the pressure inlet port and hence the pressure amplifier. The internal adapter may be a tube. The internal adapter constitutes an easy way to establish a fluid communication between the hydraulic actuator and the pressure amplifier. The length of the internal adapter may vary dependent on the stroke of the piston rod. All parts necessary for establishing such a fluid connection may therefore be assembled inside the piston rod.

In a final embodiment, the internal adapter comprises a radial sealing concentrically fixing the internal adapter relative to the piston rod. This makes assembly easy and effective. The radial sealing may be a sealing ring. As the piston inlet port as well as the pressure amplifier may be arranged concentrically with the piston rod, a concentric fixing of the internal adapter relative to the piston rod is advantageous. A space-saving assembly can be achieved. Fluid communication between the pressure amplifier and the hydraulic actuator is established.

BRIEF DESCRIPTION OF THE DRAWINGS

The invention shall be described with reference to different embodiments in connection with the figures in the forthcoming paragraphs. Therein.

DETAILED DESCRIPTION

Figure 1:
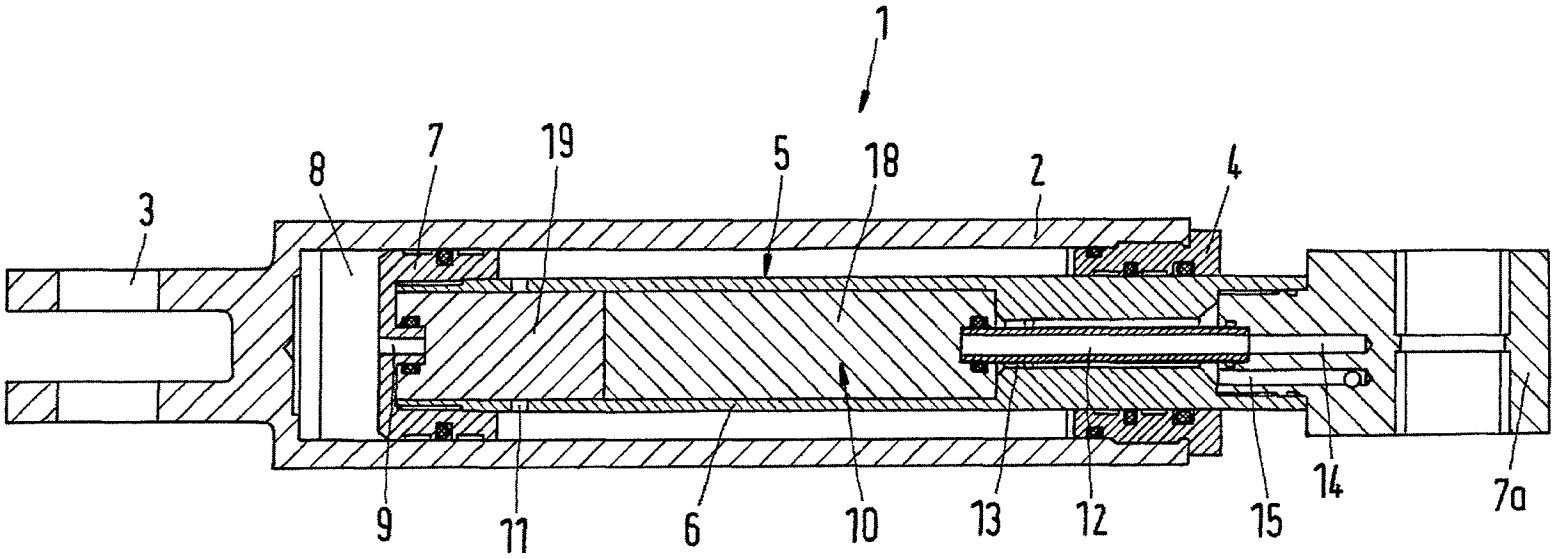
FIG. 1 depicts a hydraulic actuator with a pressure amplifier according to a first embodiment of the invention.

A hydraulic actuator 1 comprises a cylinder housing 2. The cylinder housing 2 comprises at its first axial end a cylinder eye 3. It further comprises a cylinder head 4 sealing an inner volume of the cylinder housing 2 in a fluid-tight manner. The hydraulic actuator 1 also comprises a piston 5 with a piston rod 6 being displaceably arranged inside the cylinder housing 2. The piston rod 6 engages with the cylinder head 4. The piston rod 6 comprises a piston head 7 at its first axial end and a piston eye 7*a* at its second axial end. A working chamber 8 of the hydraulic actuator 1 is arranged at the side of the piston head 7 opposite the piston eye 7*a*.

The piston head 7 comprises a piston side port 9. The piston side port 9 is arranged coaxially with the piston rod 6. It establishes a first fluid communication between the working chamber 8 of the hydraulic actuator 1 and a pressure amplifier 10. The pressure amplifier 10 is arranged inside the piston rod 6. The piston rod 6 further comprises a piston rod side port 11 establishing a second fluid communication between the pressure amplifier 10 and the inner volume of the cylinder housing 2.

At an axial end of the pressure amplifier 10 in the vicinity of the piston eye 7*a*, an internal adapter 12 is arranged. The internal adapter 12 is fixed to its position inside the piston rod 6 by means of a radial sealing 13. The radial sealing 13 fixes the internal adapter 12 coaxially with the piston rod 6. The internal adapter 12 establishes a fluid communication between the pressure amplifier 10 and a piston inlet port 14. The piston inlet port 14 is arranged inside the piston eye 7*a*. A piston outlet port 15 corresponding to the piston inlet port 14 is also arranged inside the piston eye 7*a*.

In the embodiment of FIG. 1, the pressure amplifier 10 is concentrically mounted inside the drilled piston rod 6. The pressure amplifier 10 is arranged closer to the piston head 7 than to the piston eye 7*a*. The piston inlet port 14 and the piston outlet port 15 are arranged inside the piston eye 7*a* as drilled holes. They provide hydraulic fluid with a certain, preset pressure. The pressurized hydraulic fluid is provided by an external pump (not shown), for example. The piston inlet port 14 is arranged coaxially with the piston rod 6. It is connected to the internal adapter 12. The internal adapter 12 is connected to the pressure amplifier 10. The internal adapter 12 may be a tube. It is located coaxially with the piston rod inside the drilled piston rod 6. The internal adapter 12 may change according to the stroke of the piston rod 6. The internal adapter 12 may be fixed in its position by means of the radial sealing 13. The radial sealing 13 may be a sealing ring. This radial sealing 13 keeps the internal adapter 12 in its position coaxial with the piston rod 6. Assembly becomes more easy and effective. The piston rod 6 has a diameter larger than the diameter of the internal adapter 12. Thus, an annular piston channel opens a fluid communication between the pressure amplifier 10 and the piston outlet port 15. This annular piston channel is used for backflow of hydraulic fluid from the pressure amplifier 10 to the piston outlet port 15.

Now, the pressurized hydraulic fluid is provided via the piston inlet port 14 and the internal adapter 12 to the pressure amplifier 10. The pressure of the hydraulic fluid thus provided to the pressure amplifier 10 is enhanced by means of the pressure amplifier 10. The high pressure hydraulic fluid exits the pressure amplifier 10 via the piston side port 9 into the working chamber 8 of the hydraulic actuator 1. Thus, enhanced pressure can be supplied for the hydraulic fluid inside the hydraulic actuator 1.

The embodiment of FIG. 1 shows the pressure amplifier 10 comprising an inlet section 18 as well as an active section 19. The division of the pressure amplifier 10 is due to the assembly of its internal parts. The inlet section 18 and the active section 19 are held together by external force in order to assure proper function of the pressure amplifier 10. This external force is provided by the piston head 7 onto the piston rod 6 containing both the inlet section 18 as well as the active section 19.

Otherwise, the working principle of the hydraulic actuator 1 according to the embodiment of FIG. 1 is known in the state of the art.

Figure 2:
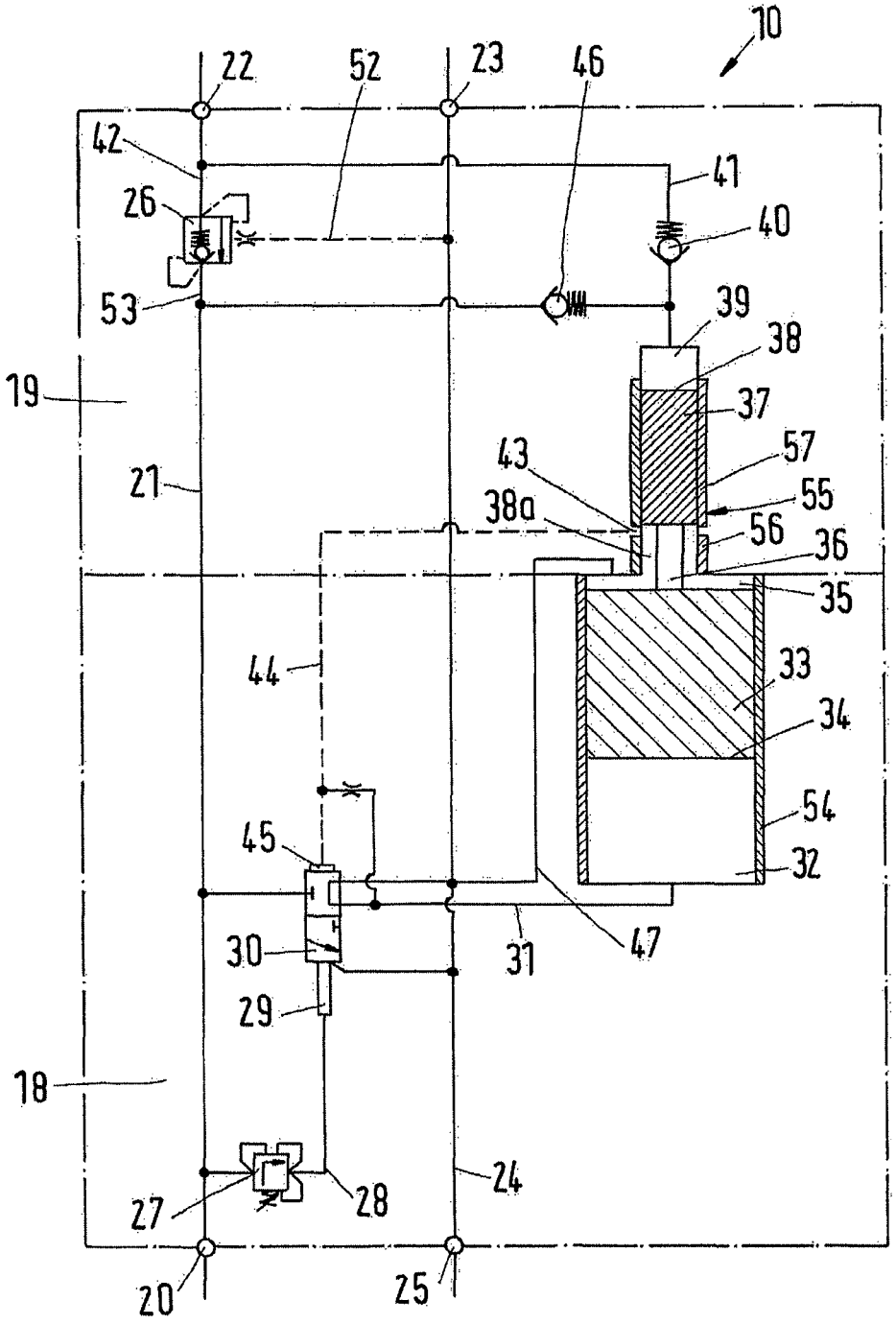
FIG. 2 depicts a first embodiment of the pressure amplifier.

As can be inferred from FIG. 2, the inlet section 18 comprises a pressure inlet port 20. The pressure inlet port 20 is connected to the internal adapter 12 of the embodiment of FIG. 1. Thereby, pressurized hydraulic fluid is provided to the pressure amplifier 10. The pressurized hydraulic fluid flows inside a main inlet channel 21. The main inlet channel 21 connects the pressure inlet port 20 to a high pressure outlet port 22. The high pressure outlet port 22 is connected to the piston side port 9 of the hydraulic actuator 1. Thereby, hydraulic fluid with an amplified pressure can be provided to the hydraulic actuator 1. The high pressure outlet port 22 is arranged inside the active section 19 of the pressure amplifier 10.

The active section 19 also comprises a backflow inlet port 23. The backflow inlet port 23 is connected to a main backflow channel 24 leading to a backflow outlet port 25. The backflow inlet port 23 is connected to the piston rod side port 11 of the hydraulic actuator 1. The backflow outlet port 24 is connected to the piston outlet port 14.

The working principle of the pressure amplifier 10 is as follows.

When there is no demand for hydraulic fluid with an amplified pressure, the hydraulic fluid enters through the pressure inlet port 20 and passes through the main inlet channel 21. An over-center valve 26 is arranged in the main inlet channel 21 inside the active section 19. When there is no demand for hydraulic fluid with amplified pressure, a check valve inside the over-center valve 26 allows full flow of the hydraulic fluid through the main inlet channel 21 to the high pressure outlet port 22. An amplification of pressure does not occur. At the same time, the backflow of hydraulic fluid is going directly from the backflow inlet port 23 to the backflow outlet port 25 via the main backflow channel 24.

Once an increased external load is applied to the hydraulic actuator 1, the pressure of the hydraulic fluid is also increasing at the pressure inlet port 20. When the pressure of the hydraulic fluid exceeds a certain preset value, a pilot sequence valve 27 opens a first pilot channel 28. Thus, the pilot sequence valve 27 is closed, as long as the pressure of the hydraulic fluid does not exceed the preset value. Once the pilot sequence valve 27 opens, however, hydraulic fluid passes through the first pilot channel 28 and exerts pressure on a first control valve pin 29 of a control valve 30. The pressure applied to the first control valve pin 29 moves the control valve 30 to a position in which hydraulic fluid may pass through it and into a low pressure piston channel 31.

The low pressure piston channel 31 leads to a low pressure chamber 32. In said low pressure chamber 32 a low pressure piston 33 is slidably arranged. The low pressure piston 33 comprises a low pressure piston surface 34. The hydraulic fluid acts on said low pressure piston surface 34 and the low pressure piston 33 starts moving in a direction opposite the low pressure piston channel 31 and toward a low pressure working chamber 35. The low pressure piston 33 is connected via a low pressure-high pressure piston rod 36 to a high pressure piston 37 inside a high pressure chamber 38*a*.

The high pressure piston 37 comprises a high pressure piston surface 38. Said high pressure piston surface 38 has a smaller area than the low pressure piston surface 34. Hence, the pressure acting on the low pressure piston surface 34 is amplified by the ratio of the two surfaces, when the high pressure piston 37 acts on hydraulic fluid inside a high pressure working chamber 39. The pressure-amplified hydraulic fluid exiting the high pressure working chamber 39 passes through a first check valve 40 opening in a direction toward the high pressure outlet port 22 by means of a first high pressure channel 41. The first high pressure channel 41 leads to a second high pressure channel 42 of the main inlet channel 21.

Once the low pressure piston 33 (and therefore the high pressure piston 37) has thus reached its end position, an aperture 43 opens a fluid communication with a second pilot channel 44. The second pilot channel 44 is connected to a second control valve pin 45 of the control valve 30. As the surface area of the second control valve pin 45 is larger than the one of the first control valve pin 29, the control valve 30 moves to its previous position. After this, the first check valve 40 closes down. As now both the pilot sequence valve 27 as well as the first check valve 40 is closed, pressure is applied to a second check valve 46. The second check valve 46 opens a fluid communication from the main inlet channel 21 to the high pressure working chamber 39. The pressure applied to the high pressure working chamber 39 begins to force the high pressure piston 37 toward the low pressure chamber 32. An annular channel 47 connects the low pressure working chamber 35 to the control valve 30. Thereby, the pilot sequence valve 27 eventually returns to its original position and the cycle is repeated.

Figure 3:
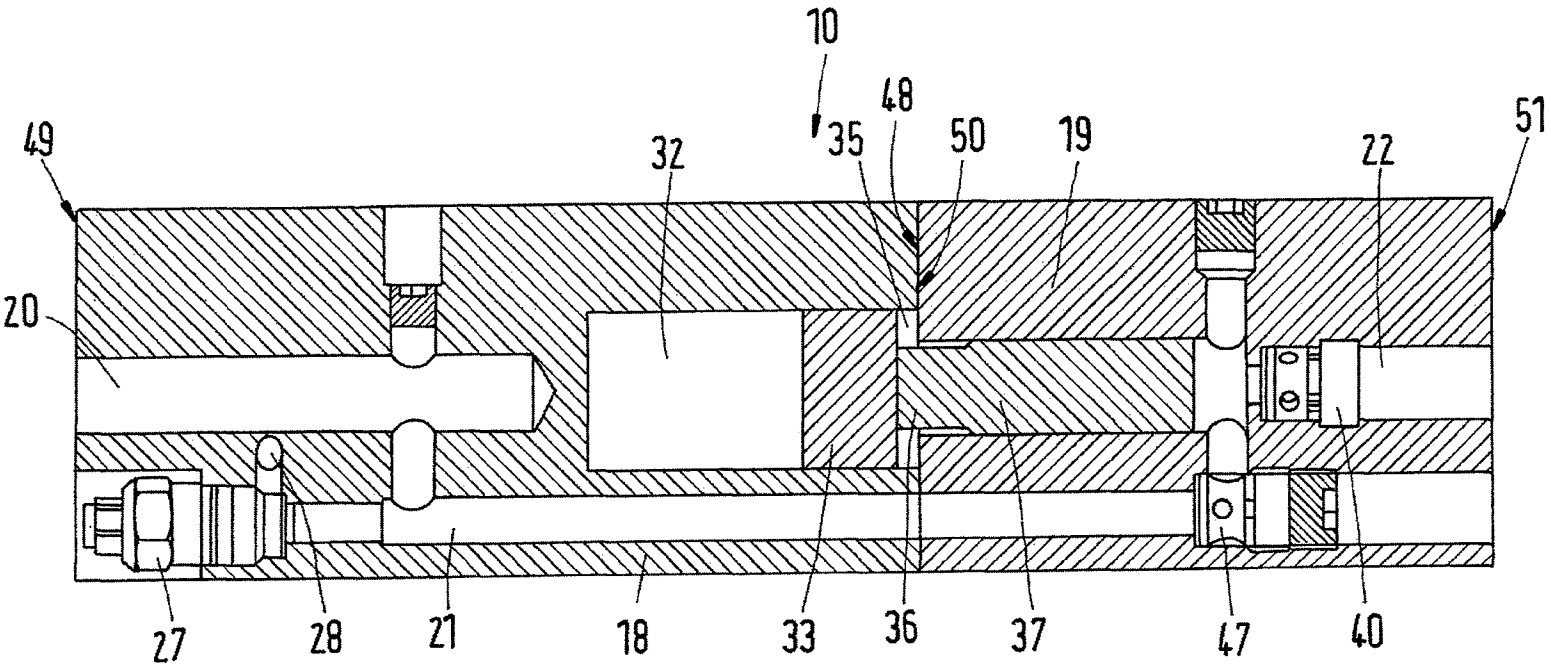
FIG. 3 depicts a second embodiment of the pressure amplifier.

The embodiment of FIG. 3 shows how the pilot sequence valve 27 can be thread mounted in an axial direction of the inlet section 18. The bottom of the pilot sequence valve 27 is then connected to the pressure inlet port 20 through the main inlet channel 21. A side port of the pilot sequence valve 27 is connected via the first pilot channel 28 to the first control valve pin 29. Setting of the pilot sequence valve 27 can be adjustable or fixed to a certain preset value.

As can also be inferred from FIG. 3, the pressure amplifier 10 consists of two separate sections: the inlet section 18 and the active section 19. The inlet section 18 comprises a first axial end face 48 and a second axial end face 49. The active section 19 comprises a first axial end face 50 and a second axial end face 51. Therein, the first axial end face 48 of the inlet section 18 and the first axial end face 50 of the active section 19 abut. Hence, in order to achieve proper function of the pressure amplifier 10, the inlet section 18 and the active section 19 are held together by external force exerted by the piston head 7 as well as the piston rod 6.

Figure 4:
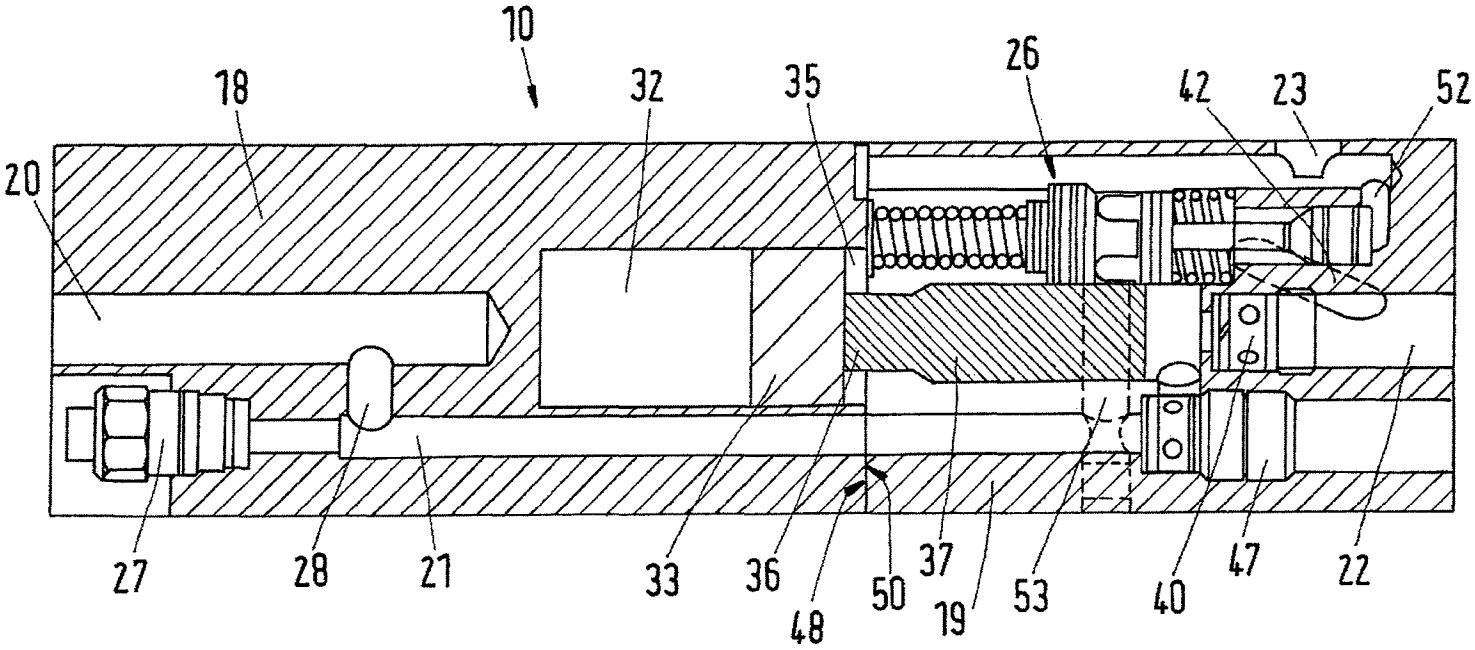
FIG. 4 depicts a third embodiment of the pressure amplifier.

In the embodiment of FIG. 4 the position of the over-center valve 26 inside the active section 19 is exemplified. The over-center valve 26 consists of multiple parts which are arranged in an axial direction of the active section 19. All such parts are mounted from the first axial end face 48 of the inlet section 18. The correct position of all the parts is achieved by covering of the inlet section 18. Hence, there is no need for a thread inside the active section 19. Once the inlet section 18 and the active section 19 are mounted together, it is not possible to set the pressure level on the over-center valve 26. Therefore, such setting is done by several types of springs.

The over-center valve 26 can provide a full flow from the pressure inlet port 20 to the high pressure outlet port 22. It can provide a load holding function at the high pressure outlet port 22. It can furthermore provide a controlled lowering function from the high pressure outlet port 22 to pressure inlet port 20. The over-center valve 26 has three connection ports: an over-center valve inlet port associated with the main inlet channel 21; an over-center valve outlet port associated with the second high pressure channel 42; and an over-center pilot port associated with a pilot line 52. The pilot line 52 connects the over-center valve 26 with the main backflow channel 24. In a direction from the pressure inlet port 20 to the high pressure outlet port 22, the over-center valve 26 provides a full flow function by means of an integrated check valve. In the opposite direction, the over-center valve 26 is kept blocked until sufficient pressure is applied to the pilot line 52. The over-center valve 26 is also connected to a bypass-channel 53.

Figure 5:
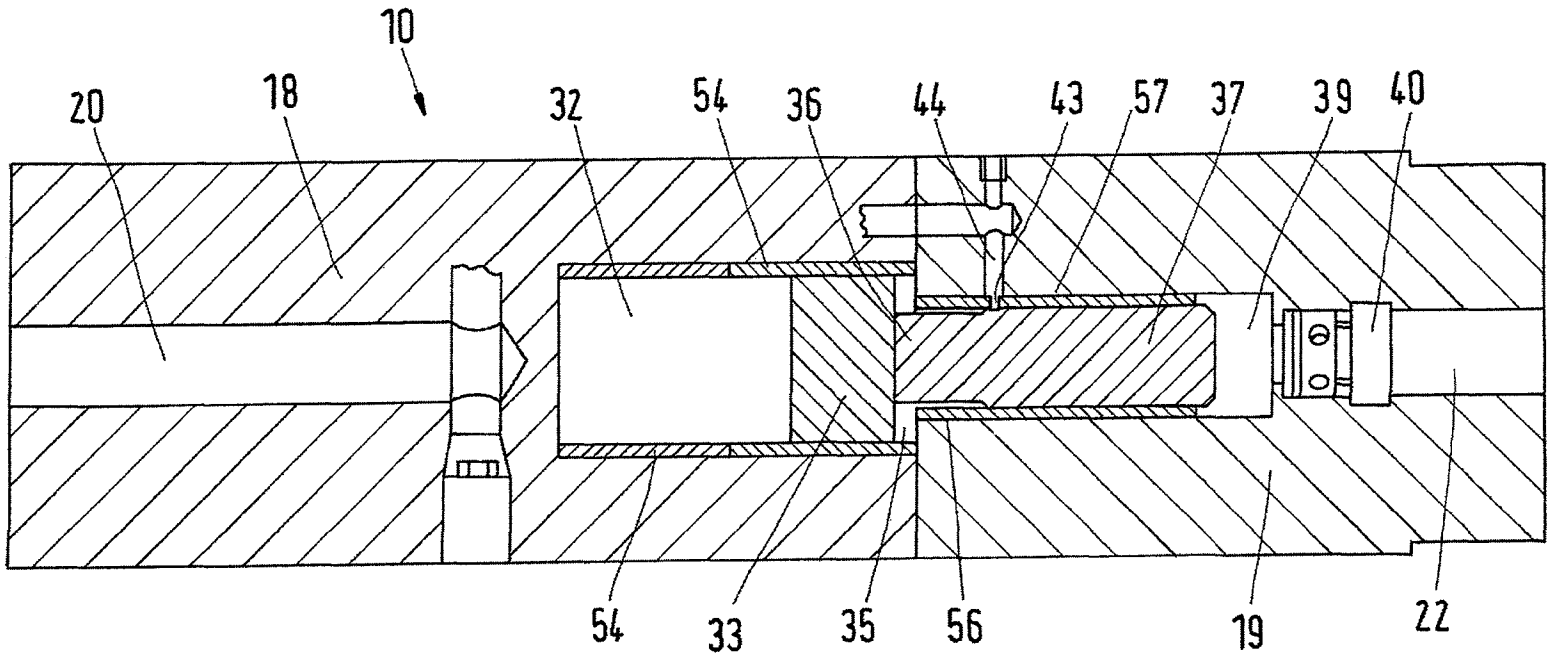
FIG. 5 depicts a fourth embodiment of the pressure amplifier.

In the embodiment of FIG. 5, the pressure amplifier 10 is shown with a low pressure piston bushing 54 and a high pressure piston bushing 55. Such integrated bushings are a proper way to increase the lifetime of both the low pressure piston 33 as well as the high pressure piston 37. The low pressure piston bushing 54 decreases the friction between the low pressure piston 33 and the walls of the low pressure chamber 32. The high pressure piston bushing 55 decreases the friction between the high pressure piston 37 and the walls of the high pressure chamber 38*a*.

The low pressure piston bushing 54 is molded into the inlet section 18. The proper position is controlled by a jig during molding process. There is a need for molding of the low pressure piston bushing 54 to a certain diameter after molding.

The high pressure piston bushing 55 comprises a first high pressure piston bushing element 56 and a second high pressure piston bushing element 57. The assembly process is the same as for the low pressure piston bushing 54. However, the first high pressure piston bushing element 56 and the second high pressure piston bushing element 57 are arranged such that the aperture 43 is arranged between them. The first high pressure piston bushing element 56 may be shorter than the second high pressure piston bushing element 57.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A hydraulic actuator comprising a cylinder housing, a piston with a piston rod being displaceably arranged inside the cylinder housing and a pressure amplifier comprising an inlet section with a pressure inlet port, an active section with a high pressure outlet port, a low pressure chamber and a high pressure chamber, wherein the inlet section is arranged inside the piston rod, wherein the low pressure chamber is stationarily arranged relative to the inlet section, wherein the inlet section comprises a pilot sequence valve being in fluid communication with the pressure inlet port, and wherein the pilot sequence valve is arranged inside the piston rod.

2. The hydraulic actuator according to claim 1, wherein the active section is arranged inside the piston rod, and wherein the high pressure chamber is stationarily arranged relative to the active section.

3. The hydraulic actuator according to claim 2, the high pressure chamber is arranged inside the active section, and wherein the piston rod comprises a piston head fixing the active section inside the piston rod.

4. The hydraulic actuator according to claim 2, wherein the low pressure chamber is arranged inside the inlet section, and wherein the piston rod fixes the inlet section inside the piston rod.

5. The hydraulic actuator according to claim 2, wherein the piston rod comprises a piston rod side port arranged in a radial direction of the piston rod establishing a fluid communication between the pressure amplifier and the cylinder housing.

6. The hydraulic actuator according to claim 1, wherein the high pressure chamber is arranged inside the active section, and wherein the piston rod comprises a piston head fixing the active section inside the piston rod.

7. The hydraulic actuator according to claim 6, wherein the low pressure chamber is arranged inside the inlet section, and wherein the piston rod fixes the inlet section inside the piston rod.

8. The hydraulic actuator according to claim 6, wherein the piston rod comprises a piston rod side port arranged in a radial direction of the piston rod establishing a fluid communication between the pressure amplifier and the cylinder housing.

9. The hydraulic actuator according to claim 1, wherein the low pressure chamber is arranged inside the inlet section, and wherein the piston rod fixes the inlet section inside the piston rod.

10. The hydraulic actuator according to claim 1, wherein the piston rod comprises a piston rod side port arranged in a radial direction of the piston rod establishing a fluid communication between the pressure amplifier and the cylinder housing.

11. The hydraulic actuator according to claim 1, wherein the pressure inlet port and the high pressure outlet port are coaxially arranged at opposite axial ends of the pressure amplifier.

12. The hydraulic actuator according to claim 1, wherein the pilot sequence valve is arranged in an axial direction of the inlet section.

13. The hydraulic actuator according to claim 12, wherein the pilot sequence valve is pressure-activated when the pressure at the pressure inlet port exceeds a preset value, thereby opening a first pilot channel from the pressure inlet port to the low pressure chamber.

14. The hydraulic actuator according to claim 1, wherein the active section comprises an over-center valve establishing a fluid communication between the pressure inlet port and the high pressure outlet port and being arranged in an axial direction of the active section.

15. The hydraulic actuator according to claim 14, wherein the over-center valve is mounted on a first axial end face of the inlet section, wherein the first axial end face of the inlet section abuts a first axial end face of the active section.

16. The hydraulic actuator according to claim 1, wherein the low pressure chamber comprises a low pressure piston and a low pressure piston bushing, wherein the low pressure piston is displaceably arranged relative to the low pressure piston bushing.

17. The hydraulic actuator according to claim 1, wherein the high pressure chamber comprises a high pressure piston and a high pressure piston bushing, wherein the high pressure piston is displaceably arranged relative to the high pressure piston bushing.

18. The hydraulic actuator according to claim 17, wherein the high pressure piston bushing comprises an aperture opening a second pilot channel establishing a fluid communication between the high pressure chamber and a control valve.

19. The hydraulic actuator according claim 1, wherein the hydraulic actuator comprises an internal adapter establishing a fluid communication between the pressure inlet port and a piston inlet port.

20. The hydraulic actuator according to claim 19, wherein the internal adapter comprises a radial sealing concentrically fixing the internal adapter relative to the piston rod.

* * * * *